US005525970A

United States Patent [19]

Friedman et al.

[11] Patent Number: 5,525,970

[45] Date of Patent: Jun. 11, 1996

+

[54] SAFETY SYSTEM AND TECHNIQUE FOR MULTI-APERTURE OPTICAL SYSTEMS

[75] Inventors: Melvin H. Friedman, Alexandria; Lesley R. M. Condiff, Woodbridge, both of Va.

[73] Assignee: The United States of America as represented by the Secretary of the Army, Washington, D.C.

[21] Appl. No.: 226,571

[22] Filed: Apr. 12, 1994

[51] Int. Cl.[6] ..... G08B 21/00

[52] U.S. Cl. ..... 340/635; 340/522; 89/1.812; 244/3.16; 102/201; 250/203.2

[58] Field of Search ..... 340/600, 635, 340/522, 555, 556, 557; 244/3.16, 3.15; 89/1.812; 102/201; 250/203.2; 348/32, 33, 25, 29, 164, 169; 354/403, 266

[56] References Cited

U.S. PATENT DOCUMENTS

| | | | |
|---|---|---|---|
| 3,711,046 | 1/1973 | Barhydt et al. | 244/3.16 |
| 4,019,422 | 4/1977 | Magnuson | 89/1.815 |
| 4,464,037 | 8/1984 | Terui et al. | 354/400 |
| 4,792,822 | 12/1988 | Akiyama et al. | 354/403 |
| 5,062,586 | 11/1991 | Hobson et al. | 244/3.16 |
| 5,106,033 | 4/1992 | Phan | 244/3.12 |
| 5,233,886 | 6/1993 | Ishida et al. | 354/409 |

*Primary Examiner*—Brent A. Swarthout
*Assistant Examiner*—Daniel J. Wu
*Attorney, Agent, or Firm*—Milton W. Lee; John E. Holford; Alain L. Bashore

[57] ABSTRACT

A safety system and technique for multi-aperture optical systems such as the TOW missile system that protects against the inadvertent activation of system function and warning the user that the system function is not ready for activation. The electrical trigger for the TOW missile system sends a signal to the firing circuits to launch a TOW missile. A micro-switch is mounted on the barrel of the near infrared (IR) tracker optical system fore optics, activated by the presence of a lens cap. A light group including a green and red light is included in the visible optical system of the TOW missile system. If the lens cap is off, then a green light is visible and firing circuits may be activated by a trigger. If the lens cap was inadvertently left on near IR tracking fore optics then a red light is visible and no voltage flows to the firing circuit when the trigger is depressed.

2 Claims, 5 Drawing Sheets

SAFETY SYSTEM AND TECHNIQUE FOR MULTI-APERTURE OPTICAL SYSTEMS

BACKGROUND OF THE INVENTION

1. Field of the Invention

The present invention generally relates to a safety system and technique for protecting against the inadvertent activation of an optical system function and more specifically, to a safety system and technique for deactivation of a system function and warning a user of a multi-aperture optical system that the system function is not ready for activation.

2. Description of Prior Art

Many optical systems become enhanced through the use of more than one aperture. A well known optical system that uses dual apertures is the modern 35 millimeter autofocus camera. These types of cameras utilize a simplified infrared (IR) rangefinder within an auto-focus adjusting device of the camera thereby providing considerable enhancement over prior art fixed-focus cameras. As the shutter button is depressed the auto-focus adjusting device emits an infrared beam from a separate rangefinder window to the target shown within the optical (viewfinder) window. The reflected return infrared beam is detected and the resultant range determined so that the visible optics is correctly focused when the shutter button is completely depressed.

Optical systems that utilize the dual-spectral region detector approach are enhanced in their operation, but are also characterized with a severe drawback. System performance is severely decreased or nonexistent when the infrared optical window is inadvertently blocked. An out of focus picture results when the infrared optical window is blocked (such as inadvertently with a finger).

While the prior art has reported using a dual aperture systems and techniques, none have established a basis for a specific apparatus that is dedicated to the task of resolving the particular problem at hand. What is needed in this instance is a safety system and technique for deactivation of a system function and warning a user of a multi-aperture optical system that the system function is not ready for activation.

SUMMARY OF THE INVENTION

It is therefore the object of the invention to provide a safety system and technique for deactivation of a system function and warning a user of a multi-aperture optical system that the system function is not ready for activation.

According to the invention, there is disclosed a safety system and technique for multi-aperture optical systems such as the TOW missile system that protects against the inadvertent activation of system function and warning the user that the system function is not ready for activation. An operator looks through the visible optical system of the TOW system and acquires the target within the reticle of visible optical system. A trigger is pressed with a mechanical force which activates firing circuits thereby sending a signal that turns on a xenon light on the TOW missile while also sending a signal which launches the missile. This enables the electronics of the near-IR tracker optical system and visible optical system. An optical signal as the emission from the xenon light is received by the near-IR tracker optical system assuming a lens cap was not left on the system. Near IR tracker optical system sends a signal to the visible optical system which is utilized to show the coordinates of the missile relative to the optical axis of the visible optical system The operator applies an appropriate force on the entire launcher system to keep the visible optical axis on target. An error signal between the optical axis and the position of TOW missile provides a corrective electrical signal through wires that are attached to the moving missile thus providing guidance correction to the missile.

The TOW missile system malfunctions if the lens cap is left on the fore optic of the near IR tracker optical system so that it is not possible to generate a corrective electrical signal for the missile. A micro-switch is mounted on the barrel of fore optics of the near infrared (IR) Tracker system. A light group including a green and red light are present within the visible optical system. If the lens cap is off, then the green light goes on and firing circuits are activated when the trigger is depressed. If the lens cap was inadvertently left on near IR tracking fore optics then the red light activates and no voltage flows to the firing circuit when the trigger is depressed.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
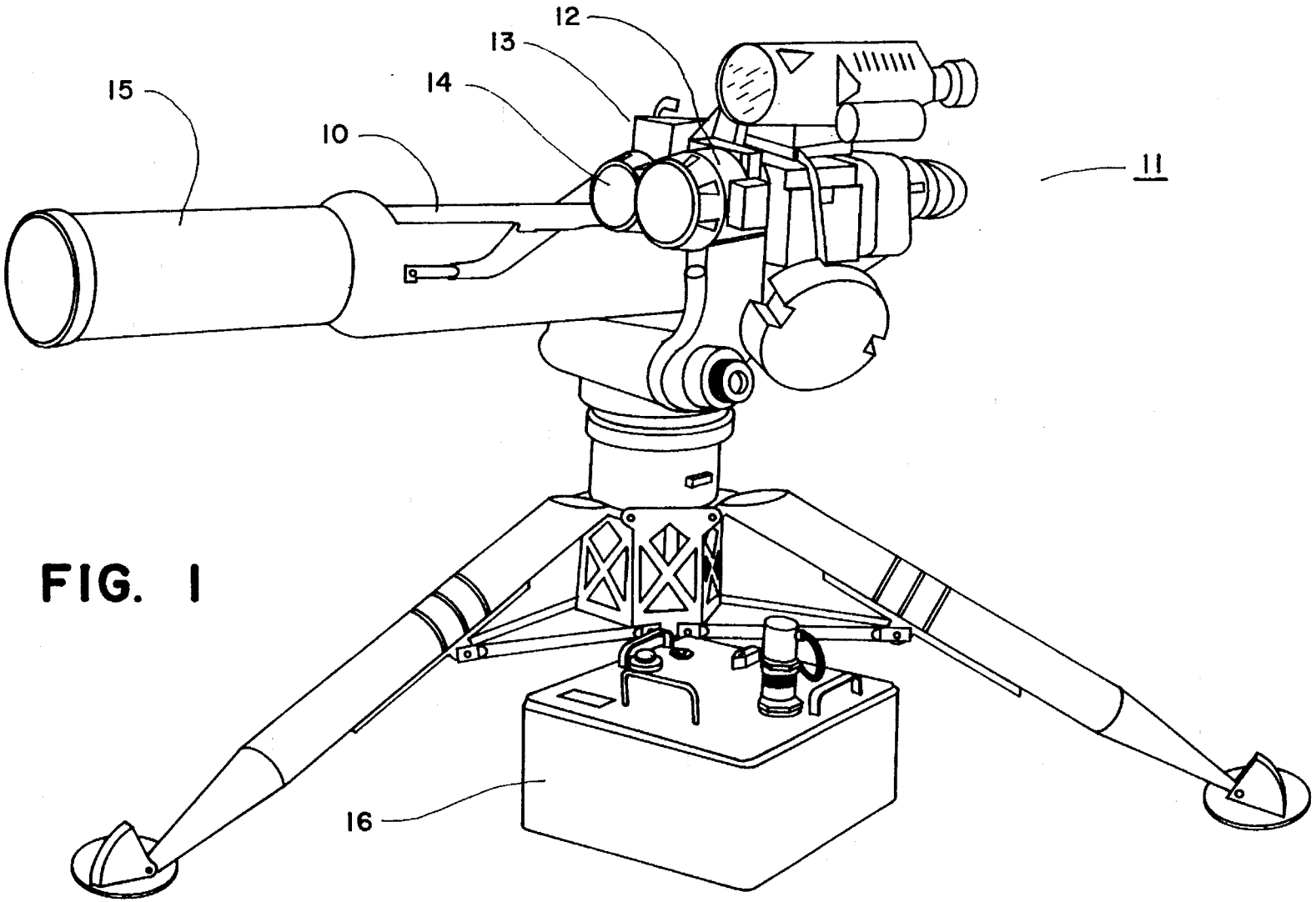
FIG. 1 is a profile view of the TOW missile system.

Referring now to the drawings, and more particularly to FIG. 1, there is shown a profile view of the presently fielded TOW missile system commonly known as the TOW AN/TAS-4. It is understood that while the system utilized in the present embodiment is the TOW missile system, any multi-aperture optical system may be utilized in the practice of the present invention. TOW (tube launched optically tracked, wire command, link guided) is a heavy antitank assault missile weapon system capable of accurate, effective fire against armored vehicles and hard targets. The TOW missile (not shown) is encased in disposable sealed launcher container 10 which acts as a protective container and the breech end of the launch system. TOW launcher system 11 of the TOW system includes visible optical system 12 and near-IR tracker optical system 13 with fore optics 14. The operator looks through visible optical system 12 and acquires the target within the visible optical axis. Launcher tube 15 which provides an exit for the missile from launcher container 10 is thus in initial alignment with the target. Upon achieving target alignment, the operator fires the missile by manually depressing an electrical trigger switch. The flight path of the missile is controlled via guidance signals sent by guidance set 16 transmitted over a wire link which connects the in flight missile with the launcher. The operator's only task after firing the missile is to maintain alignment of the target on the sight reticle of visible optical system 12 until missile impact. Deviations of the missile from the intended trajectory are sensed by the near IR tracker optical system 13. Unfortunately, when the standard lens cap is left on fore optics 14 of near IR tracker optical system 13, no deviation corrections can be made.

Figure 2:
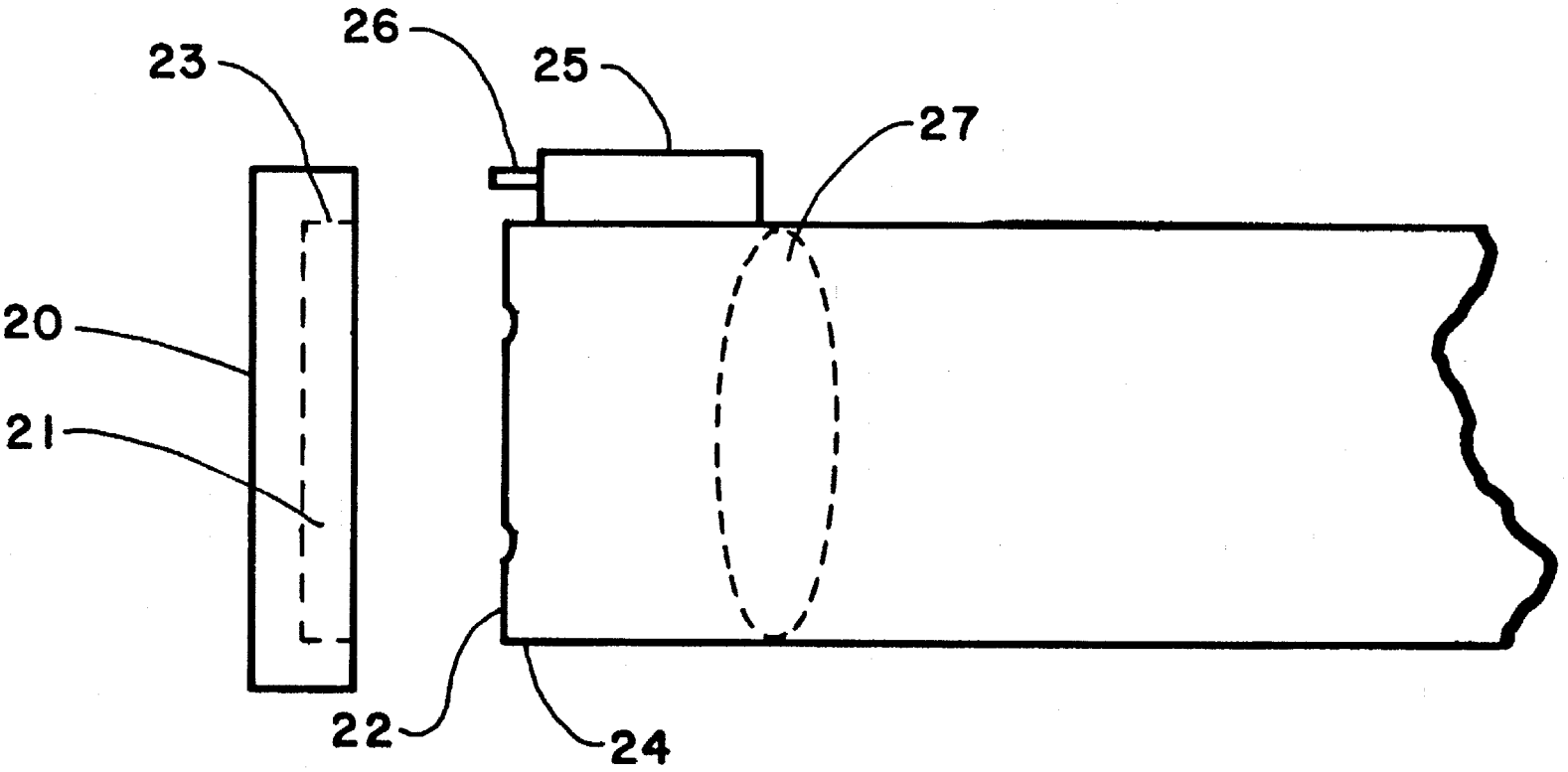
FIG. 2 is a side view of the lens barrel front for the near IR tracker optical system in the TOW missile system utilizing the present invention.

FIG. 2 is a side view of the lens barrel of fore optics 14 for near IR tracker optical system 13 shown in FIG. 1. Lens cap 20 of FIG. 2 includes annular inner area 21 which is designed to be removably coupled to barrel end 22 so as to cover near IR optics. Inner annular sleeve 23 slidingly engages with outer barrel end surface 24 so that an appropriate snug fit is obtained whereby lens 27 is protected. The diameter of inner annular sleeve 23 is dimensioned so as to make a snug fit on lens barrel 24 an sufficient to keep a micro-switch actuator depressed. The outer diameter of lens cap 20 is dimensioned so as to be large enough to depress micro-switch actuator 25. The depth of inner annular sleeve 23 is dimensioned to exceed the travel of the micro-switch actuator 25. Normally actuator end 26 is not in electrical contact with actuator 25 so that lens cap 20 can be made of a conductor such as metal or a tough non-conductor such as plastic. To prevent lens cap 20 from getting lost when it is not in use, it may be chained to barrel 24 or the body of the sensor.

Micro switch 25 is a single pole double throw switch which is open if no lens cap is pressing against actuator end 26, and when closed by lens cap 20 pressing on actuator end 26 would activate a warning signal for the operator and if desired this signal could be used to disable the firing system to prevent system operation. Micro switch 25 should be located at the small end of the rectangular parallelepiped which makes up the micro switch housing. Only a force of 5 ounces should be required to depress switch 25 to the on position and once depressed, a small force of nominally 1.0 ounce would keep it depressed by a wide margin. The pretravel distance of the actuator movement, defined as the distance the actuator moves before the switch closes, should not be so small that the actuator could get turned on accidentally. Neither should the pretravel distance be too large as the depth of inner annular sleeve, shown in FIG. 2, must be at least as large as the pretravel and overtravel distances. The overtravel distance is defined as the additional movement the actuator moves after the switch closes. Micro switch 25 should be capable of handling the required currents, nominally measured in milliamps and voltages, of less than or equal to 24 volts.

Figure 3:
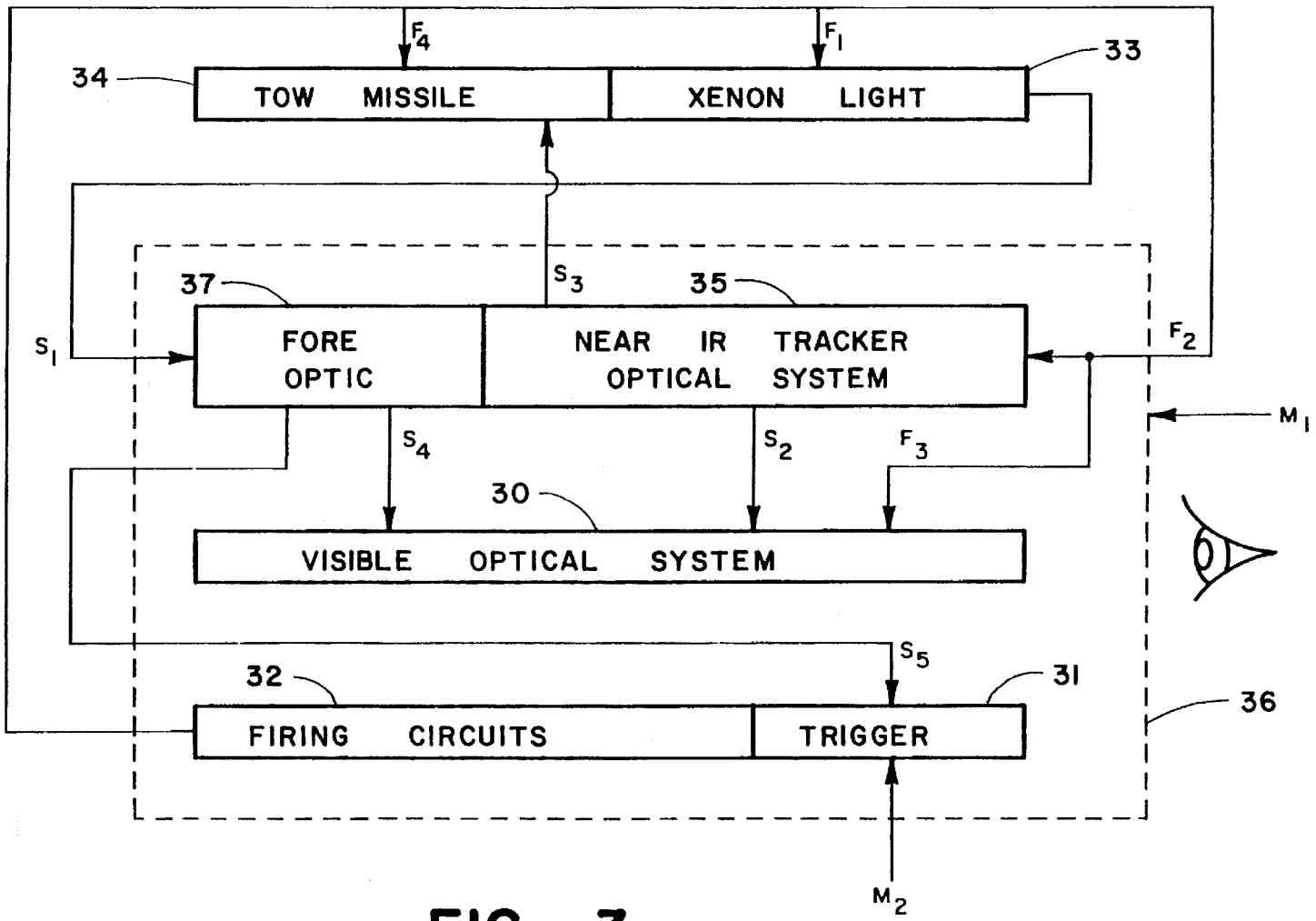
FIG. 3 is a simplified block diagram of signal pathways of the TOW missile system utilizing the present invention.

FIG. 3 is a simplified block diagram of electrical, optical, and mechanical signal pathways of the TOW missile system utilizing the present invention. The operator looks through the visible optical system 30, acquires the target within the reticle of visible optical system 30, and presses trigger 31 with a mechanical force M2 which activates firing circuits 32 thereby sending signal F1 that turns on xenon light 33 of TOW missile 34, while sending signal F4 which launches missile 34. This enables the electronics of near-IR tracker optical system 35 and visible optical system 30 with input signals F2 and F3 respectively, and the missile 34 is launched in the direction of the target. Optical signal S1 is the emission from xenon light 33 that is received by near-IR tracker optical system 35 (assuming lens cap was not left on the system). Near IR tracker optical system 35 sends signal S2 to visible optical system 30 which conveys the coordinates of the missile relative to the optical axis of visible optical system 30. The operator applies an appropriate force M1 on the entire launcher system 36 to keep the visible optical axis on target.

An error signal between the optical axis and the position of TOW missile 34 provides a corrective electrical signal S3 through wires that are attached to the moving missile 34 which provides guidance correction to missile 34. The system malfunctions if a lens cap is left on fore optic 37 of near IR tracker optical system 35 so that it is not possible to generate a corrective electrical signal S3 for TOW missile 34. With micro-switch 25 of FIG. 2 on fore optic 37 in FIG. 3, there is sent electrical signal S4 to visible optical system 30 and electrical signal S5 to trigger 31 to provide warning and disablement of trigger 31.

Figure 4:
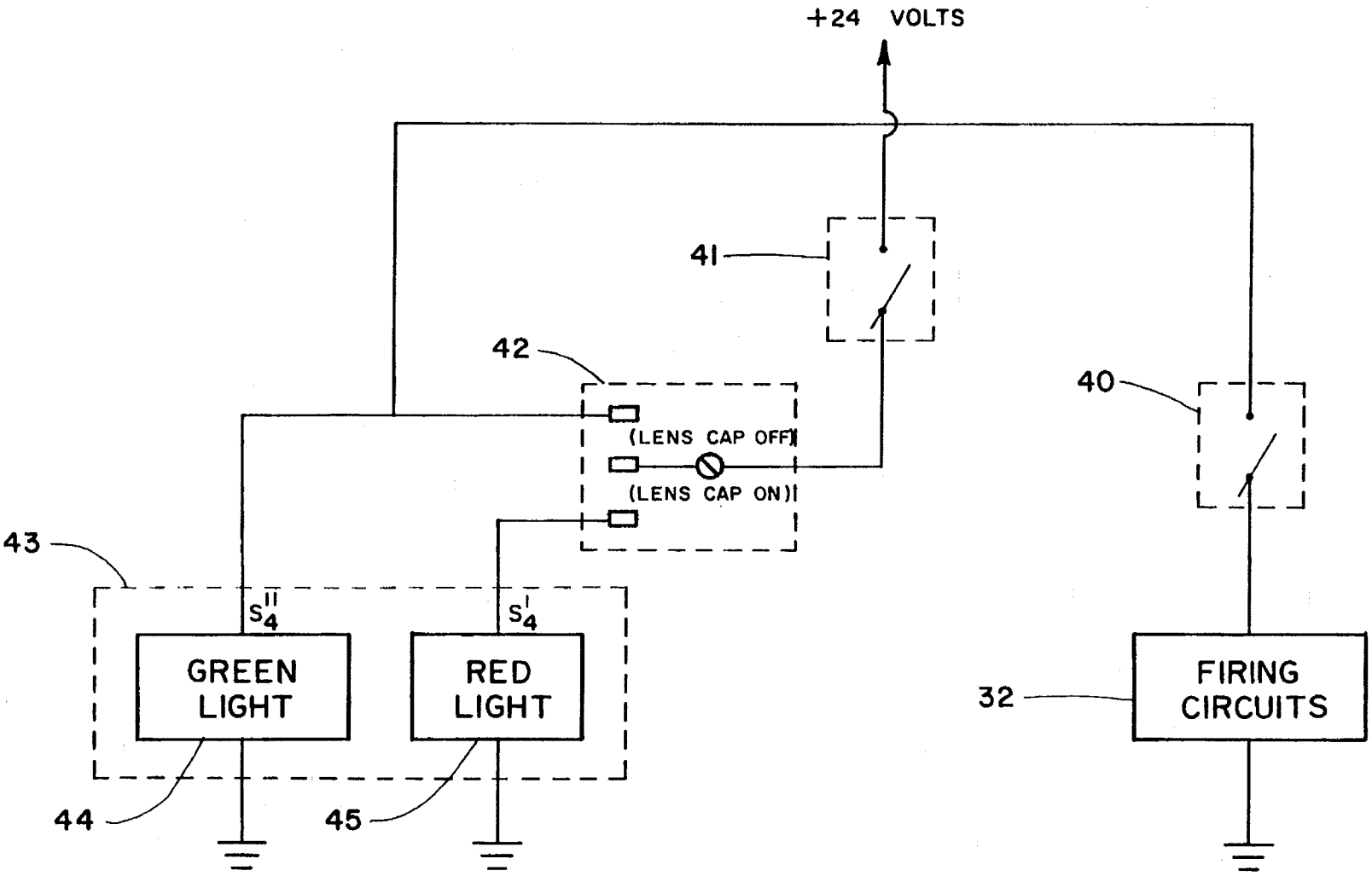
FIG. 4 is a simplified electrical diagram of the present invention.

FIG. 4 is a simplified electrical diagram of the present invention. Switch 40 is the electrical switch of trigger 31 of FIG. 3 that sends a signal to the firing circuits 32 which launch TOW missile 34. Switch 41 is the arming switch and switch 42 is micro-switch 25 of FIG. 2 which is mounted on barrel 16 of fore optic 37 shown in FIG. 3. Switch 42 is a single throw double pole micro throw switch wherein one pole corresponds to cap 20 of FIG. 2 on and the other pole corresponds to lens cap 20 off. Light group 43 includes green light 44 and red light 45 that are activated by signals S4" and S4' respectfully which are subsignals of electrical signal S4 of FIG. 3. With the lens cap on, the pole of switch 42 is in the "lens cap on" position and with the lens cap off, the pole of switch 42 is in the "lens cap off" position. If the lens cap is off and arming switch 41 is closed, then green light 44 goes on and firing circuits 32 may be activated when trigger switch 40 is closed. If the arming switch 41 is closed but the lens cap was inadvertently left on near IR tracking fore optic 37 of FIG. 3, then red light 45 of FIG. 4 activates and no voltage flows to the firing circuit 32 if trigger 40 is closed. It is understood that the invention is not limited to the specific warning circuit disclosed but that any circuit may be utilized that performs the function of an alert.

Figure 5:
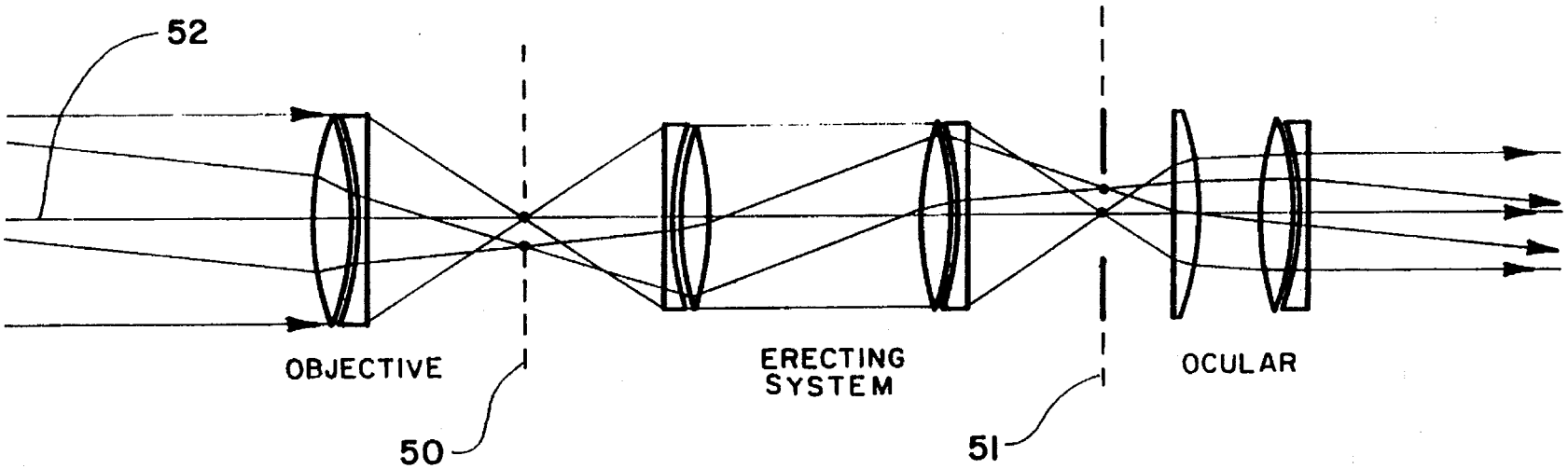
FIG. 5 is a simplified optical ray-trace diagram of the visible optical system for the TOW missile system utilizing the present invention.

FIG. 5 is a simplified optical ray-trace diagram of the visible optical system for the TOW missile system utilized in the present invention. The visible optical system is an erecting terrestrial telescope which includes intermediate image plane 50 and 51. Green light 43 and red light 44 can be mounted in either intermediate image plane 50 or 51, at a radial distance from optic axis 52 sufficient to put lights 50 and 51 near the edge of the field of view. The invention is not limited to the specific color, type of visible warning lights, or their positioning within the overall system. While the present invention is described for use in a TOW missile system, it is understood that the invention is not limited to the system of the present embodiment but that any dual aperature optical system may be used with the present invention.

While this invention has been described in terms of preferred embodiment consisting of a warning system for the TOW missile system, those skilled in the art will recognize that the invention can be practiced with modification within the spirit and scope of the appended claims.

Having thus described our invention, what we claim as new and desire to secure by Letters Patent is as follows:

1. A safety system for deactivation of a TOW missile weapon system trigger and warning a user that the trigger is not ready for activation including:

a visible optical subsystem which includes the capability of visible spectrum viewability;

a means for producing at least one signal from the visible optical subsystem indicating visible spectrum viewability, as a first signal;

a non-visible optical subsystem which includes the capability of non-visible spectrum viewability;

a means for producing at least one signal from the non-visible optical subsystem indicating, non-visibility spectrum viewability as a second signal;

the trigger which requires both first and second signals for correct operation of the trigger;

a means for activation of the trigger;

a means for sensing that the second signal can be produced, such that if the second signal cannot be produced a warning is made and the means for activation of the trigger is deactivated.

2. A safety technique for deactivation of a TOW missile weapon system trigger and warning a user that the trigger is not ready for activation including:

providing the capability of viewing in the visible spectrum from a visible optical subsystem;

providing the capability of producing at least one signal from the visible optical subsystem indicating visible spectrum viewability as a first signal;

providing the capability of viewing in the non-visible spectrum from a non-visible optical subsystem;

providing the capability of producing at least one signal from the non-visible optical subsystem indicating non-visible spectrum viewability, as a second signal;

providing the trigger which requires both first and second signals for correct operation of the trigger;

providing the capability for producing activation of the trigger;

sensing that the second signal can be produced, such that if the second signal cannot be produced a warning is made and the means for activation of the trigger is deactivated.

* * * * *